US010156328B2

(12) United States Patent
Xu et al.

(10) Patent No.: US 10,156,328 B2
(45) Date of Patent: Dec. 18, 2018

(54) LED BAR LIGHTING AND EXHIBITION CABINET HAVING SAME

(71) Applicants: Self Electronics Co., Ltd., Ningbo, Zhejiang (CN); Wanjiong Lin, Ningbo, Zhejiang (CN); Self electronics USA Corporation, Norcross, GA (US)

(72) Inventors: Bozhang Xu, Zhejiang (CN); Fawei Zhang, Zhejiang (CN)

(73) Assignee: Self Electronics Co., Ltd., Ningbo (CN)

( * ) Notice: Subject to any disclaimer, the term of this patent is extended or adjusted under 35 U.S.C. 154(b) by 0 days.

(21) Appl. No.: 15/629,698

(22) Filed: Jun. 21, 2017

(65) Prior Publication Data

US 2017/0370539 A1 Dec. 28, 2017

(30) Foreign Application Priority Data

Jun. 22, 2016 (CN) ..... 2016 1 0470802

(51) Int. Cl.

| | |
|---|---|
| ***F21V 5/00*** | (2018.01) |
| ***F21S 4/28*** | (2016.01) |
| ***F21V 5/04*** | (2006.01) |
| ***F21V 5/08*** | (2006.01) |
| ***F21V 29/89*** | (2015.01) |
| ***A47F 3/00*** | (2006.01) |
| ***F21V 3/02*** | (2006.01) |
| *F21W 131/405* | (2006.01) |
| *F21Y 103/10* | (2016.01) |
| *F21Y 115/10* | (2016.01) |

(52) U.S. Cl.

CPC ..... *F21S 4/28* (2016.01); *A47F 3/001* (2013.01); *F21V 3/02* (2013.01); *F21V 5/045* (2013.01); *F21V 5/08* (2013.01); *F21V 29/89* (2015.01); *F21W 2131/405* (2013.01); *F21Y 2103/10* (2016.08); *F21Y 2115/10* (2016.08)

(58) Field of Classification Search

CPC .... A47F 3/001; F21S 4/28; F21V 3/02; F21V 5/04; F21V 5/045; F21V 5/08; F21V 29/89; F21Y 2103/10; F21W 2131/405

USPC ..... 362/125

See application file for complete search history.

(56) References Cited

U.S. PATENT DOCUMENTS 5,301,092 A * 4/1994 Santosuosso ..... A47F 3/001 312/223.5

9,212,804 B2 * 12/2015 Zhang ..... G02B 19/0047

(Continued)

*Primary Examiner* — Claude J Brown

(74) *Attorney, Agent, or Firm* — Wang Law Firm, Inc.

(57) ABSTRACT

An LED bar lighting and an exhibition includes a receiving chamber and at least one LED bar lighting. The receiving chamber includes a mounting reference line. Each of the at least one LED bar lighting includes a bar house, a plurality of LED chips, and a lens column. Each of the LED chips includes a chip optical axis. The lens column includes a lens optical axis parallel to the chip optical axis, a first light emitting surface intersected with the lens optical axis, and a second light emitting surface. The first light emitting surface is a condensing lens. The second light emitting surface includes a convex lens, and a plane surface located between the first light emitting surface and convex lens. An angle between the lens axis and the mounting reference line in the cross section perpendicular to the axial direction of the bar house is an acute angle.

10 Claims, 3 Drawing Sheets

(56) References Cited

U.S. PATENT DOCUMENTS

2006/0198144 A1* 9/2006 Miyairi ..... A47F 3/001 362/257
2007/0035965 A1* 2/2007 Holst ..... F21V 3/04 362/608
2007/0076427 A1* 4/2007 Reo ..... F21V 5/008 362/555
2007/0171647 A1* 7/2007 Artwohl ..... A47F 3/001 362/276
2008/0285264 A1* 11/2008 Whitehouse ..... A47B 97/00 362/217.05
2009/0002990 A1* 1/2009 Becker ..... A47F 3/001 362/249.01
2010/0059767 A1* 3/2010 Kawasaki ..... G02B 6/0096 257/89
2010/0135036 A1* 6/2010 Matsuba ..... F21S 41/322 362/516
2010/0277908 A1* 11/2010 Hu ..... F21V 15/01 362/235
2011/0058357 A1* 3/2011 Anderson ..... A47F 3/001 362/125
2011/0096533 A1* 4/2011 Sekela ..... A47F 3/001 362/125
2013/0229789 A1* 9/2013 Yoshida ..... A47F 3/0426 362/125
2014/0226361 A1* 8/2014 Vasylyev ..... F21V 7/0091 362/606
2014/0307447 A1* 10/2014 Ohta ..... F21K 9/60 362/311.02
2015/0002747 A1* 1/2015 Lee ..... A47F 3/001 348/725
2015/0116990 A1* 4/2015 Cassidy ..... F21V 5/04 362/126
2016/0131311 A1* 5/2016 Qin ..... F21S 4/28 362/92
2016/0153705 A1* 6/2016 Dubuc ..... A47F 3/0404 312/405.1
2016/0201876 A1* 7/2016 Lv ..... F21V 5/08 362/268
2016/0238202 A1* 8/2016 Mallory ..... F21V 5/04
2016/0281957 A1* 9/2016 Fujii ..... F21V 5/04
2016/0290595 A1* 10/2016 Tsai ..... F21V 5/08
2016/0312979 A1* 10/2016 Ebner ..... G02B 19/0066
2016/0377257 A1* 12/2016 Xu ..... F21V 5/08 362/224
2017/0002995 A1* 1/2017 Yang ..... F21V 7/09
2017/0023206 A1* 1/2017 Tsai ..... F21V 5/045

* cited by examiner

LED BAR LIGHTING AND EXHIBITION CABINET HAVING SAME

RELATED APPLICATION

This present application claims benefit of the Chinese Application, CN 201610470802.8, filed on Jun. 22, 2016.

BACKGROUND

1. Technical Field

The present application relates to a lighting device, and more particularly to an LED bar lighting and an exhibition cabinet having same.

2. Description of the Related Art

Light emitting diode (LED) is growing in popularity due to decreasing costs and long life compared to incandescent lighting and fluorescent lighting. Recently, a number of LED lighting apparatuses have been designed to replace the halogen apparatus, as well as other traditional incandescent or fluorescence lighting apparatuses. In some places such as exhibition halls, jewelry stores, museums, supermarkets, and some home lighting, such as large villas, will use a lot of strip LED lamps. Moreover, in addition to lighting equipments, such as general traffic lights, billboards, motor-lights, etc., also use light-emitting diodes as light source. As described above, for the light-emitting diodes as a light source, the advantage is power saving, and the greater brightness. Therefore, the use has been gradually common.

However, since the LED chip used in the strip LED lamps is close to the point light source and light angle of the LED chip is 180 degrees, the glare thereof is too bad to make people uncomfortable when these LED lamps are used in the exhibition cabinet. The usual way is to block the glare by some light-blocking equipment for prevent the glare from entering into the eyes of the person. However, this method is to increase the overall volume of the LED lamp, and causes the loss of light, which is not conducive to improving the efficiency of the whole lamps.

Therefore, it is necessary to provide an LED bar lighting and an exhibition cabinet having same which makes it possible to improve the efficiency thereof.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout two views.

DETAILED DESCRIPTION

The present application is illustrated by way of example and not by way of limitation in the figures of the accompanying drawings. It should be noted that references to "an" or "one" embodiment in this application are not necessarily to the same embodiment, and such references mean at least one.

Figure 1:
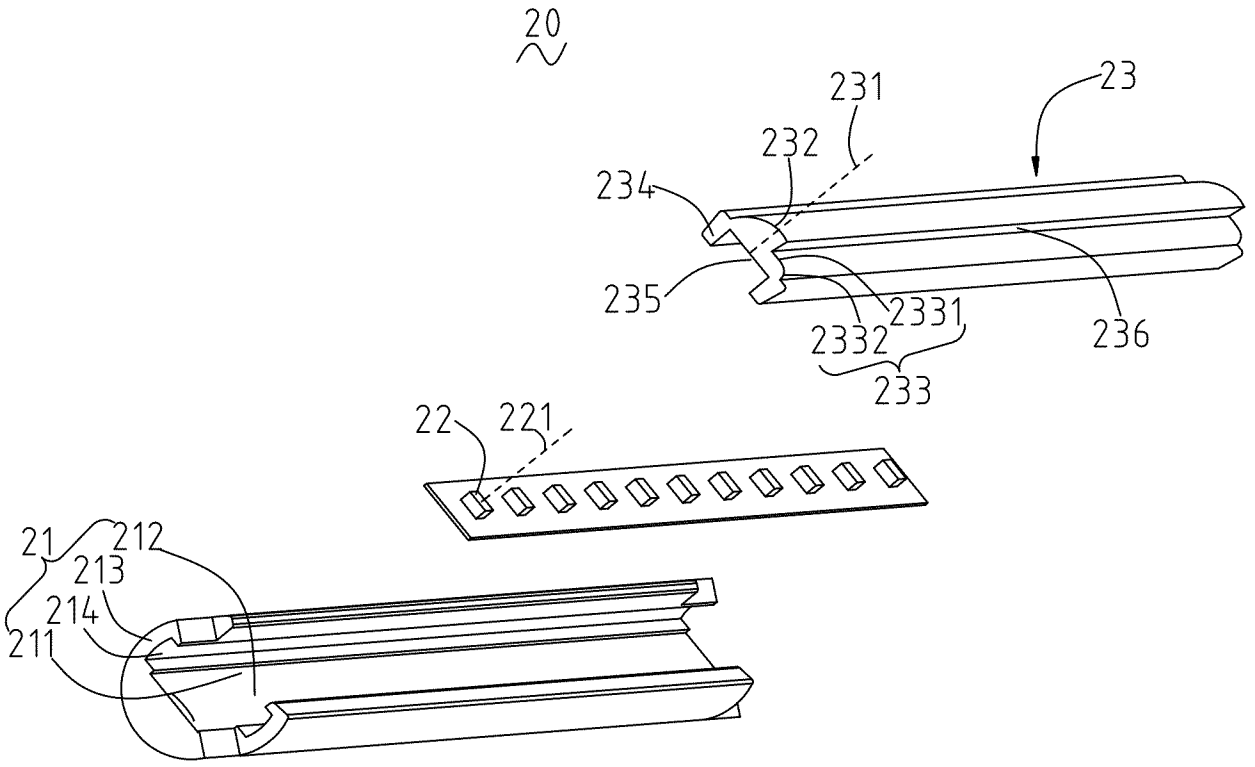
FIG. 1 is an explored view of an LED bar lighting according to an embodiment.
Figure 2:
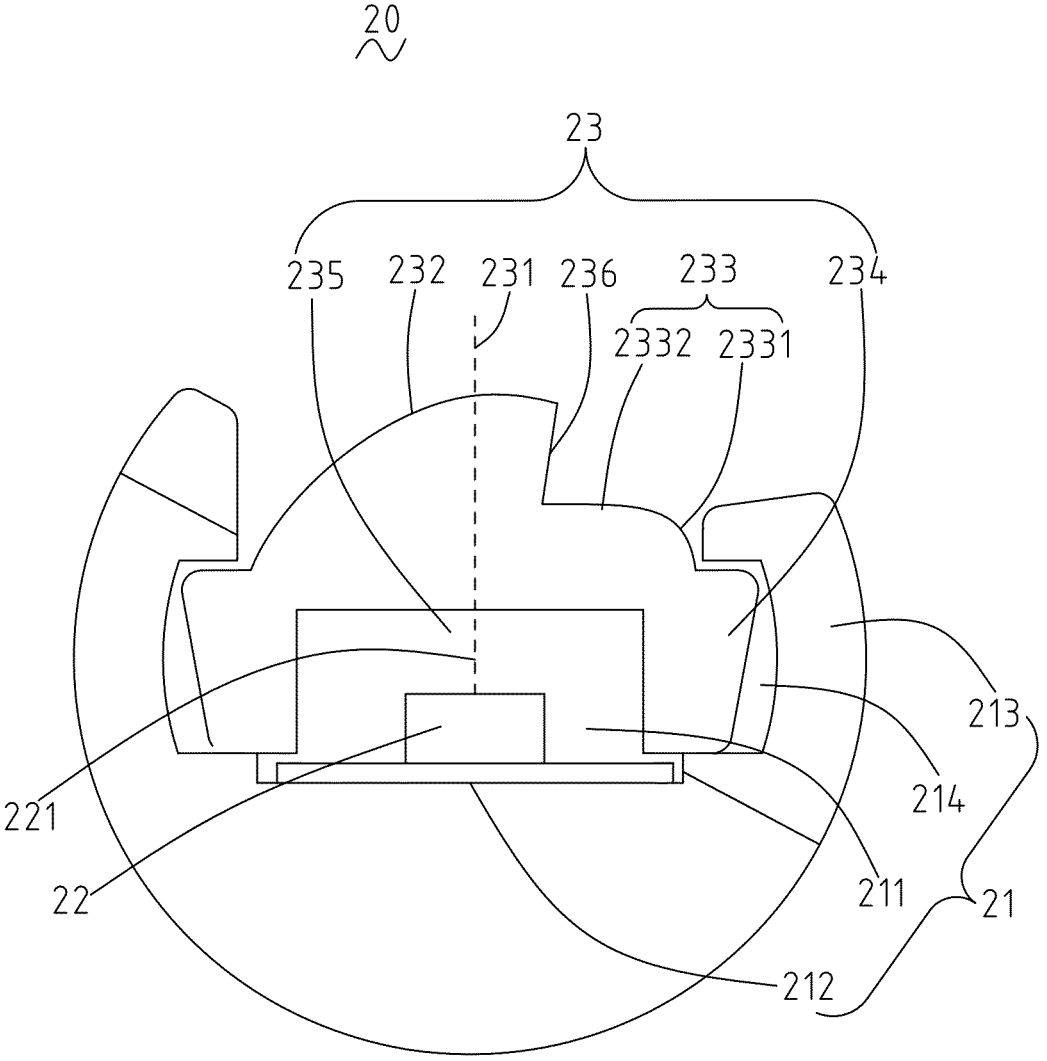
FIG. 2 is a cross section view of the LED bar lighting of FIG. 1 taken along a direction perpendicular to an axial direction of a bar house of the LED bar lighting.
Figure 3:
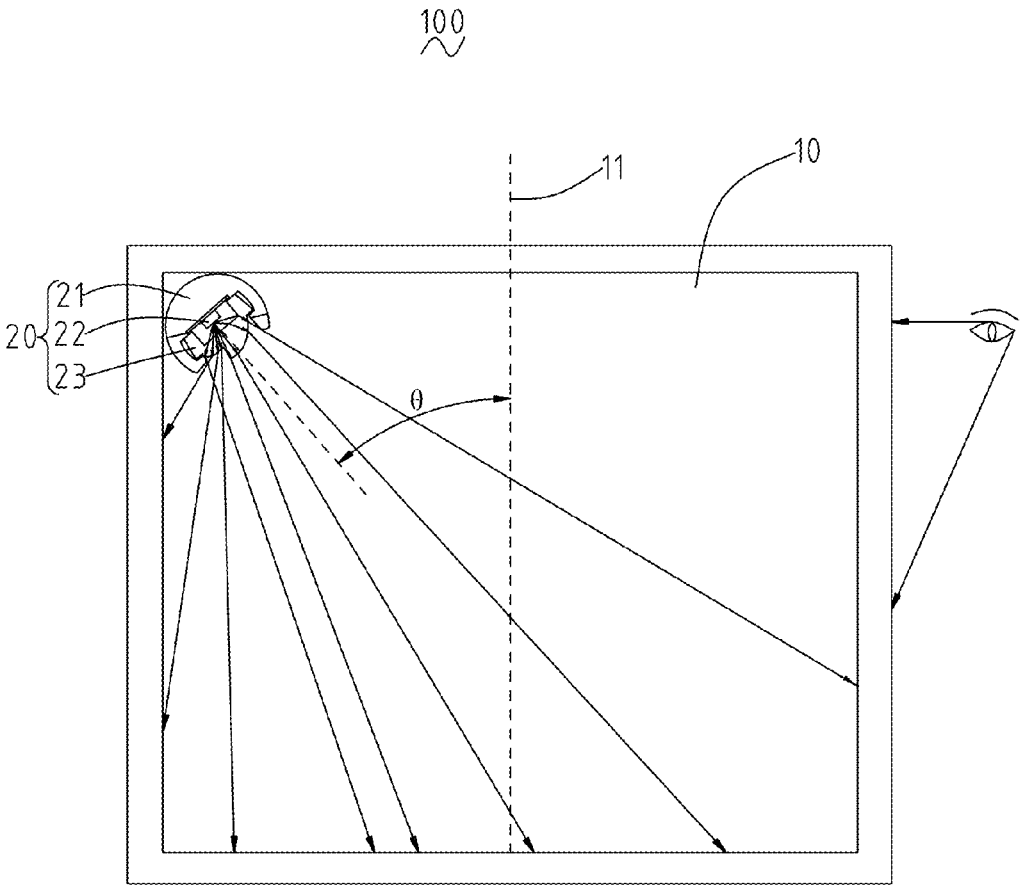
FIG. 3 is a light path diagram of an exhibition cabinet having the LED bar lighting of FIG. 1 according to the embodiment.

Referring to FIG. 1 to FIG. 3, an exhibition cabinet 100 is shown. The exhibition cabinet 100 includes a receiving chamber 10, and at least one LED bar lighting apparatus 20 mounted in the receiving chamber 10. It can be understood that the exhibition cabinet 100 further includes other parts, such as a base, glass doors and windows, wires, etc., which are known to those skilled in the art and will not be described here.

The receiving chamber 10 is used to place an exhibition, such as a jewel, etc., and its shape can be customized according to the user. In the present embodiment, the receiving chamber 10 is the most common rectangle. Moreover, the goods are generally placed horizontally. Therefore, during the receiving chamber 10 is designed, a mounting reference line 11 is generally provided. The mounting reference line 11 is vertical to the horizon line, which is a reference for designing and installing the receiving chamber 10. It is of course be appreciated that in some special cases the mounting reference line 11 may not be perpendicular to the horizon line, but there must have a reference line as a guide for designing and installing the exhibition cabinet 100.

The LED bar lighting 20 includes a bar house 21, a plurality of LED chips 22 arranged in the bar house 21, and a lens column 23 mounted on the bar house and extending along the direction of light emitted from the LED chips 22. It can be understood that the LED bar lighting 20 further includes other function modules, such as circuit board, power supply module, end caps, holders, and so on.

The bar house 21 has a groove and includes a receiving cavity 211 for receiving the power supply module, a bottom portion 212 for mounting the lens column 23, and tow side walls 213 disposed on both sides of the bottom portion 212. The bar house 21 is made of metal material or non-metallic material. However, for heat dissipation, the bar house 21 is extruded with a metal material, such as aluminum alloy. In the present embodiment, the receiving cavity 211 has a semicircular cross section. The receiving cavity 211 is configured for receiving the circuit board, the LED chips 22, and the lens column 23. The bottom portion 212 is configured for disposing the circuit board. The two side walls 213 are spaced apart from each other and arranged two sides of the bottom portion 212 so as to form a gap for mounting the lens column 23. The two side walls 213 provide two slots 214 on the inner sides thereof. The two slots 214 are configured for inserting the lens column 23.

The LED chips 22 may be light emitting diode known to those skilled in the art and will not be described again. Each of the LED chips 22 includes a chip optical axis 221. As well known, the chip optical axis 221 is a guideline for light distribution design and the center line of the LED chips 22. In the LED bar lighting 20, at least two LED chips 22 are provided to form a strip style. In the present embodiment, the LED bar lighting 20 provides a plurality of LED chips 22, and may be 30 or more. The LED chips 22 are mounted on the circuit board which is assembled in the bar house 21 so as to assemble the LED chips 22 into the bar house 21.

The lens column 23 is also a bar and is inserted into the bar house 21. In order to explain the structural shape of the lens column 23, a cross section of the lens column 23 taken along a direction perpendicular to an axial direction of the bar house 21 is shown in FIG. 2. In the cross section perpendicular to the axial direction of the bar house 21, the lens column 23 includes a lens optical axis 231 parallel to the chip optical axis 221, a first light emitting surface 232 intersected with the lens optical axis 231, a second light emitting surface 233 disposed in an extending direction of the lens optical axis 231 and is misaligned with the first light emitting surface 232, two installing portions 234 arranged the sides of the first and second light emitting surfaces 232, 233, and a groove 235 for receiving the LED chips 22. The chip optical axis 221 divides the receiving cavity 211 into approximately two equal halves and the first light emitting surface 232 covering more than one half of the receiving cavity 211. The second light emitting surface 233 covers less than one half of the receiving cavity 211. The lens optical axis 231, like the chip optical axis 221 of the LED chips 22, is a virtual line which is a reference or a guide for the lens design. The lens optical axis 231 is parallel to the chip optical axis 221, and it is preferable that the lens optical axis 231 coincides with the chip optical axis 221. The first light emitting surface 232 is a condensing lens so as to narrow the light angle at one side of the lens optical axis 231. As is shown in FIG. 3, the light of the LED chips 22 on the side of the lens optical axis 231 is deflected toward the bottom of the receiving chamber 10 due to the action of the first light emitting surface 232. The light angle of the first light emitting surface 232 should be less than 70 degrees in order to prevent glare, and the angle between the radius of the first light emitting surface 232 and the lens optical axis 231 is an acute angle in the cross section perpendicular to the axial direction of the bar house 21 and along the light emitting direction of the LED chips 22. As a result, the emitted light of the first light emitting surface 232 is refracted toward the lens optical axis 231. The second light emitting surface 232 includes a convex lens 2331 and a plane surface 2332 located between the convex lens 2331 and the first light emitting surface 232. The arc surface of the convex lens 2331 is tangent to the plane surface 2332 to form a smooth curved surface. Since the first light emitting surface 232 is intersected with the lens optical axis 231, the second light emitting surface 233 must be on one side of the lens optical axis 231 and does not intersect with the lens optical axis 231 at the cross section perpendicular to the axial direction of the bar house 21. As a result, the plane surface 2332 refracts the light away from the lens axis 231. As is shown in FIG. 3, the light of the plane surface 2332 is refracted toward the bottom of the receiving chamber 10. Moreover, since the convex lens 2311 has a converging effect, it collects part of the light at the edge of the optical LED chip 22 while other part of the light directs toward the side wall of the receiving chamber 10 to achieve the purpose of illumination it. The position of the human eye and the range that can be seen by the human eye under normal circumstances is shown in FIG. 3. As can be seen from the FIG. 3, it is possible to use the lens column 23 to deploy light to avoid direct injection into the human eye so as to achieve the purpose of anti-glare.

The two installing portions 234 are provided on the two end sides of the first and second light emitting surfaces 232, 233 in the cross section perpendicular to the axial direction of the bar house 21. The two installing portions 234 are inserted into the bar house 21, and in particular, the two installing portion 234 are inserted into the two slots 214 of the bar house 21, respectively.

The groove 235 is opened along the axial direction of the lens column, and is configured for receiving the plurality of the LED chips 22 so as to take full advantage of the light emitted from the LED chips 22.

In the cross section perpendicular to the axial direction of the bar house 21, the lens column 23 further includes a transition surface 236 located between the first and second light emitting surfaces 232, 233. Since the first light emitting surface 232 is misaligned with the second light emitting surface 233 along the light emitting direction of the LED chips 22, a cliff, i.e., the transition surface 236, is formed between the first and second light emitting surfaces 232, 233. In order to prevent the transition surface 236 from forming total internal reflection thereon, an angle between the transition surface 236 and the lens optical axis 231 is an acute angle. Due to the total internal reflection, the light beam emitted from the transition surface 236 is either shot out of the lens to form glare, or will be re-reflected back to the lens column 23, thereby reducing the light efficiency.

When the LED bar lighting 20 is installed into the receiving chamber 10, the mounting reference line 11 should be used as a reference line, and in particular, the angle between the lens optical axis 231 and the mounting reference line 11 should be an acute angle. In the present embodiment, the angle is 45 degrees.

The light emitted by the first and second light emitting surfaces 232, 233 of the lens column 23 is deployed in accordance with desires so that the light can be propagated in accordance with a designated path, and then the glare can be reduced. Moreover, it is possible to avoid loss of the light emitting efficiency due to the light blocking. As a result, the exhibition cabinet 100 using the LED bar lighting 20 has a better lighting effect.

While the disclosure has been described by way of example and in terms of exemplary embodiment, it is to be understood that the disclosure is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An LED bar lighting apparatus, comprising:

a bar house;

a plurality of LED chips arranged inside the bar house, each of the LED chips comprising having a chip optical axis; and a lens column mounted on the bar house and extending along a direction of light emitted from the LED chips, the lens column comprising a first installing portion, a second installing portion connected to the first installing portion, a recess for receiving the plurality of the LED chips is defined between the first installing portion and the second installing portion, a lens optical axis parallel to the chip optical axis, a first light emitting surface connected to the first installing portion, intersected with the lens optical axis, the first light emitting surface is convex, a transition surface connected to the first light emitting surface, and a second light emitting surface connected to the transition surface and extended to the second installing portion, wherein the first light emitting surface is a condensing lens, the second light emitting surface comprises a convex lens, and a plane surface, the plane surface is connected to the transition surface and the convex lens is connected to the second installing portion, the transition surface forms a cliff between the first light emitting surface and the second light emitting surface, and the first light emitting surface covers more than one half of the recess.

2. The LED bar lighting apparatus as claimed in claim 1, wherein a light angle of the first light emitting surface is less than 70 degrees.

3. The LED bar lighting apparatus as claimed in claim 1, wherein a light emitted from the first light emitting surface is refracted toward the lens optical axis.

4. The LED bar lighting apparatus as claimed in claim 1, wherein an angle formed between the transition surface and the lens optical axis is an acute angle.

5. The LED bar lighting apparatus as claimed in claim 1, wherein an arc surface of the convex lens is tangent to a plane surface.

6. The LED bar lighting apparatus as claimed in claim 1, wherein an angle formed between a radius of the convex lens and the lens optical axis is an acute angle along the direction of light emitted from the LED chips.

7. The LED bar lighting apparatus as claimed in claim 1, wherein an angle formed between a radius of the condensing lens and the lens optical axis is an acute angle.

8. An exhibition cabinet, comprising:

a receiving chamber, the receiving chamber having a mounting reference line; and at least one LED bar lighting apparatus assembled inside the receiving chamber, each of the at least one LED bar lighting apparatus comprising:

a bar house;

a plurality of LED chips arranged inside the bar house, each of the LED chips having a chip optical axis; and a lens column mounted on the bar house and extending along a direction of light emitted from the LED chips, the lens column comprising a first installing portion, a second installing portion connected to the first installing portion, a recess for receiving the plurality of the LED chips is defined between the first installing portion and the second installing portion, a lens optical axis parallel to the chip optical axis, a first light emitting surface connected to the first installing portion, intersected with the lens optical axis, the first light emitting surface is convex, a transition surface connected to the first light emitting surface, and a second light emitting surface connected to the transition surface and extended to the second installing portion, wherein the first light emitting surface is a condensing lens, the second light emitting surface comprises a convex lens, and a plane surface, the plane surface is connected to the transition surface and the convex lens is connected to the second installing portion, the transition surface forms a cliff between the first light emitting surface and the second light emitting surface, the first light emitting surface covers more than one half of the recess, an angle formed between the lens optical axis and a mounting reference line is an acute angle.

9. The exhibition cabinet as claimed in claim 8, wherein the angle formed between the lens optical axis and the mounting reference line is 45 degrees.

10. The exhibition cabinet as claimed in claim 8, wherein the mounting reference line is vertical to a horizon line.

* * * * *